United States Patent [19]

Baker

[11] Patent Number: 4,932,450

[45] Date of Patent: Jun. 12, 1990

[54] CORNER CUTTING SHEAR MACHINE AND METHOD FOR FORMING INSIDE CORNERS IN A ONE-PIECE ARTICLE

[76] Inventor: Kevin D. Baker, 732 N. Kirkwood Rd., Kirkwood, Mo. 63122

[21] Appl. No.: 389,511

[22] Filed: Aug. 4, 1989

[51] Int. Cl.[5] ..... B27M 1/08

[52] U.S. Cl. ..... 144/367; 83/862; 83/875; 144/3 R; 144/75; 144/147

[58] Field of Search ..... 144/3 R, 67, 75, 121, 144/147, 162 R, 136 R, 367; 83/862, 875

[56] References Cited

U.S. PATENT DOCUMENTS

| | | | |
|---|---|---|---|
| 514,053 | 2/1894 | Tengdin | 144/147 |
| 706,458 | 8/1902 | Seaquest | 144/75 |
| 824,146 | 6/1906 | Richards | 144/147 |
| 824,818 | 7/1906 | Richards | 144/147 |
| 1,631,526 | 6/1927 | Hartman | 144/147 |

*Primary Examiner*—W. Donald Bray
*Attorney, Agent, or Firm*—Rogers, Howell & Haferkamp

[57] ABSTRACT

A machine and method for forming an inside corner portion in a one-piece article material where the inside corner portion is produced by the meeting at a corner of first and second adjacent profiles defined by grooves or members. The inside corner portion at the corner is formed by machining the article material to form portions of the profiles not including the entirity of the inside corner portion, and then shearing the article material in the corner to form the inside corner portion. The machine has first and second cutter assemblies each having a shear cutter. Each shear cutter is mounted for movement along a path between retracted and extended positions such that the path of movement of the cutter of the first assembly meets with the path of movement of the cutter of the second assembly. The article having partial profiles formed therein is mounted with the cutter's positioned and seated with the profiles and such that the profiles are aligned along the paths of movement of the cutters. The cutters are driven along their respective paths while seated with their respective profiles between the retracted and extended positions, such that driving the cutters to the extended position shears the material near the corner to form the inside corner portion.

40 Claims, 4 Drawing Sheets

FIG. 1.
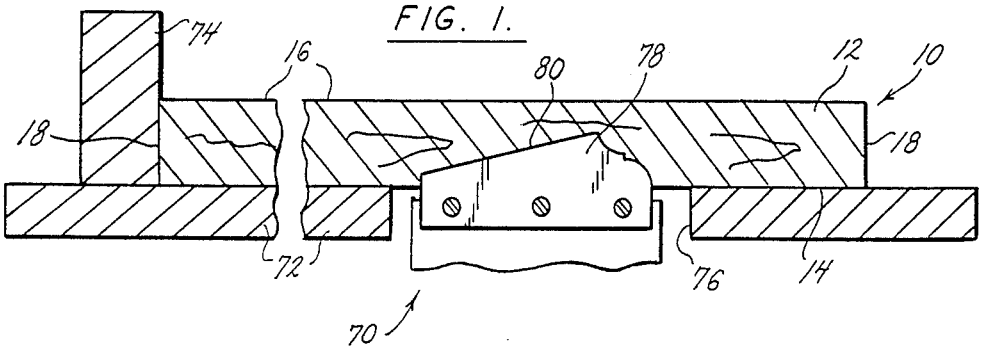
FIG. 2.
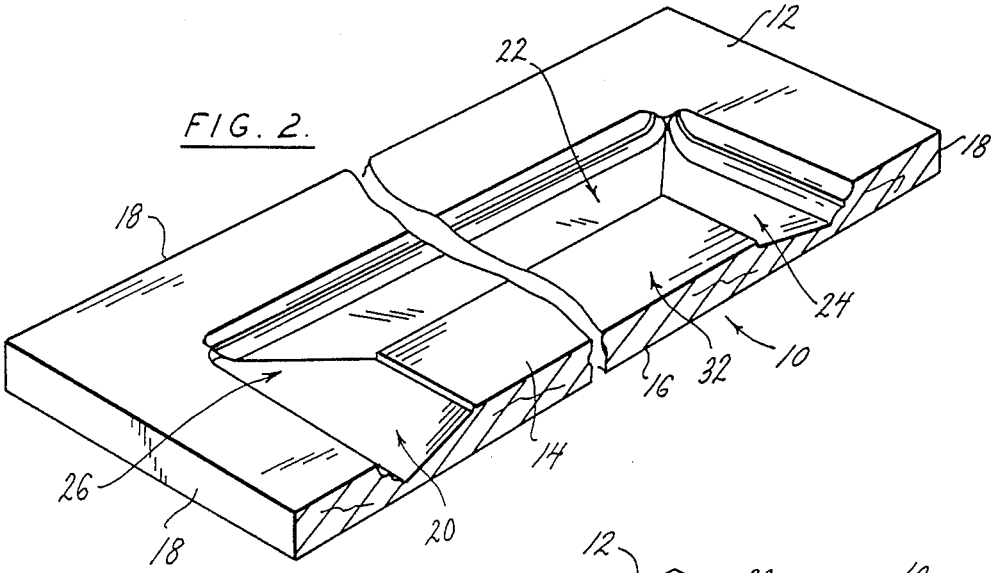
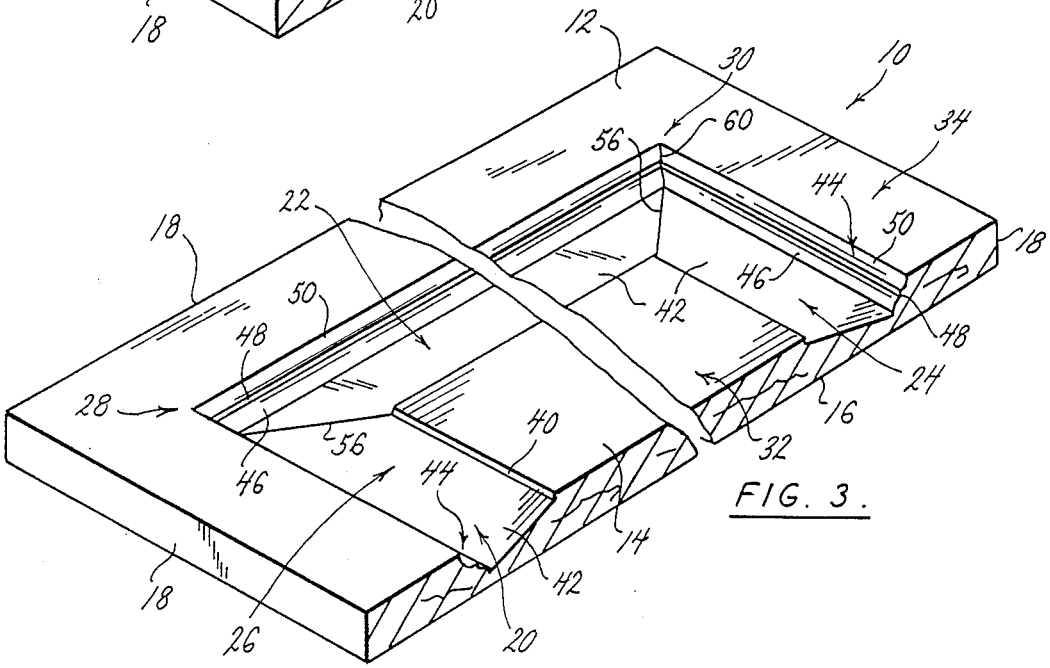
FIG. 3.

FIG. 4.
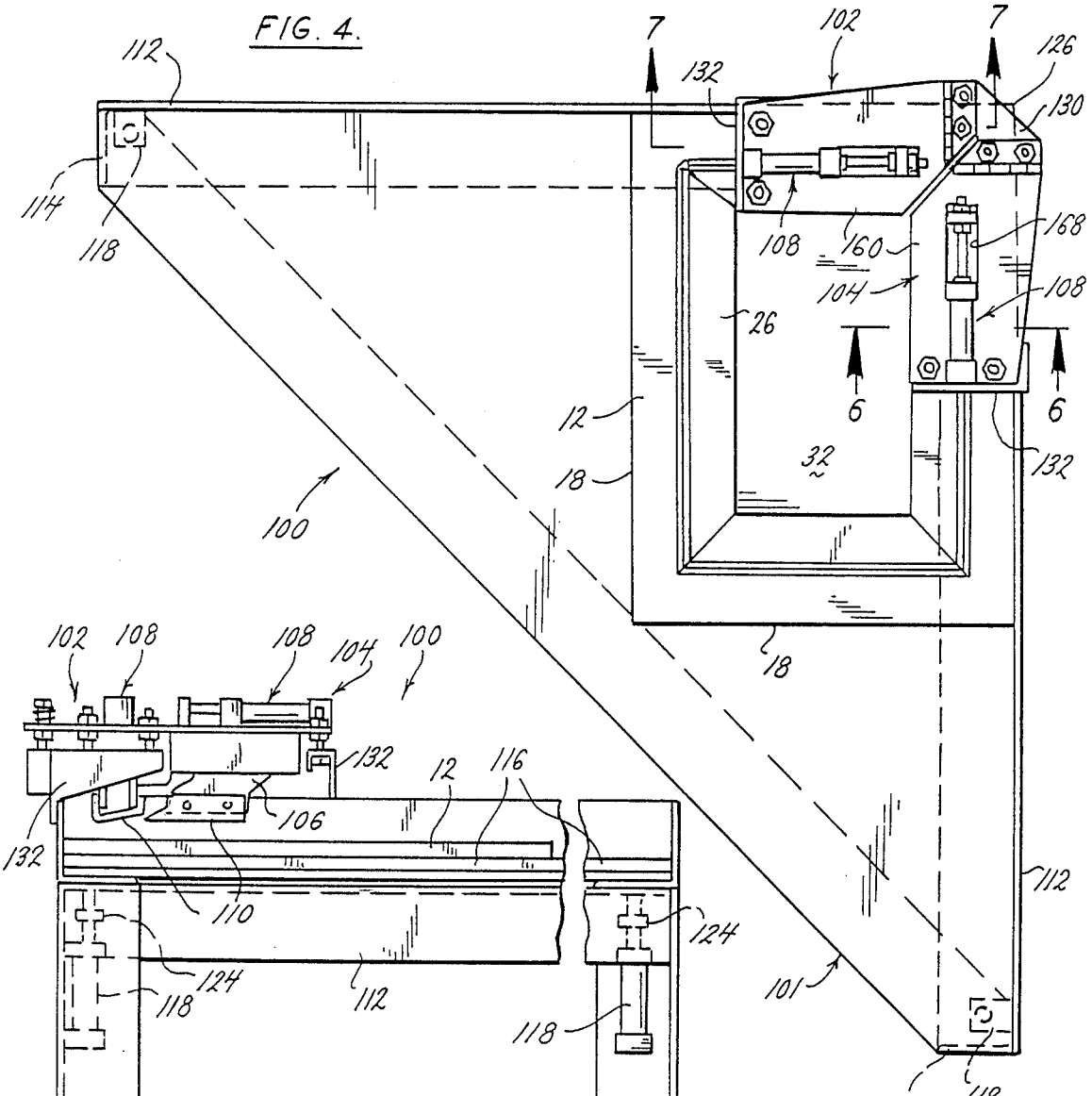
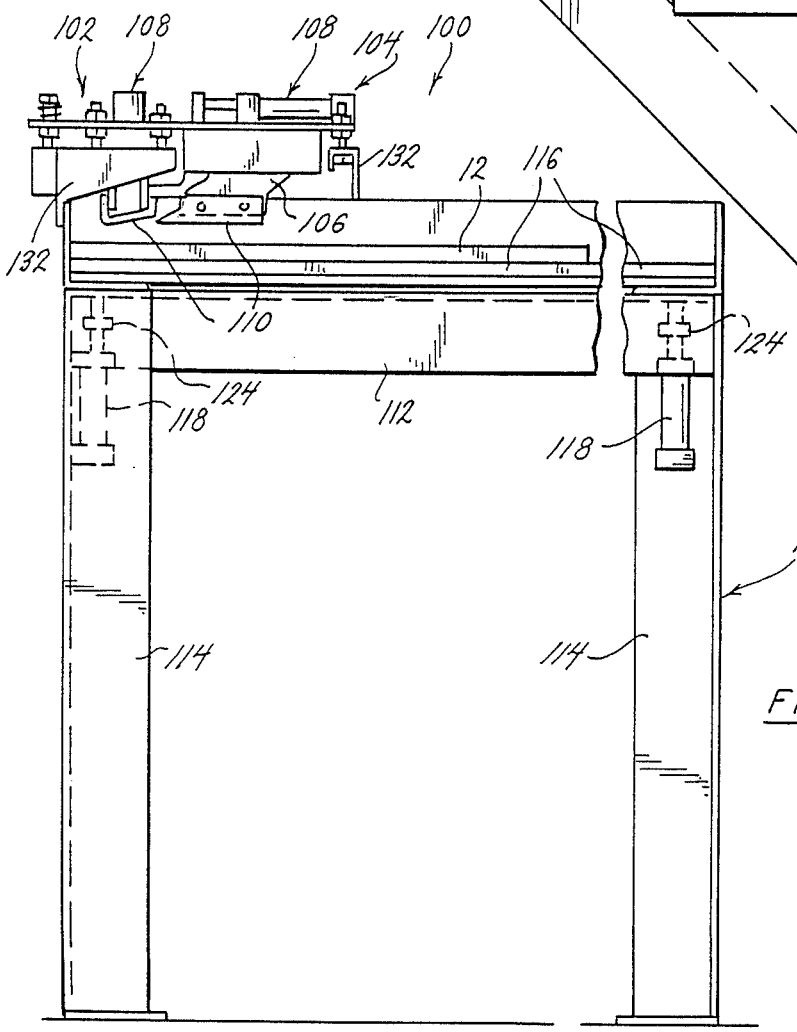
FIG. 5.

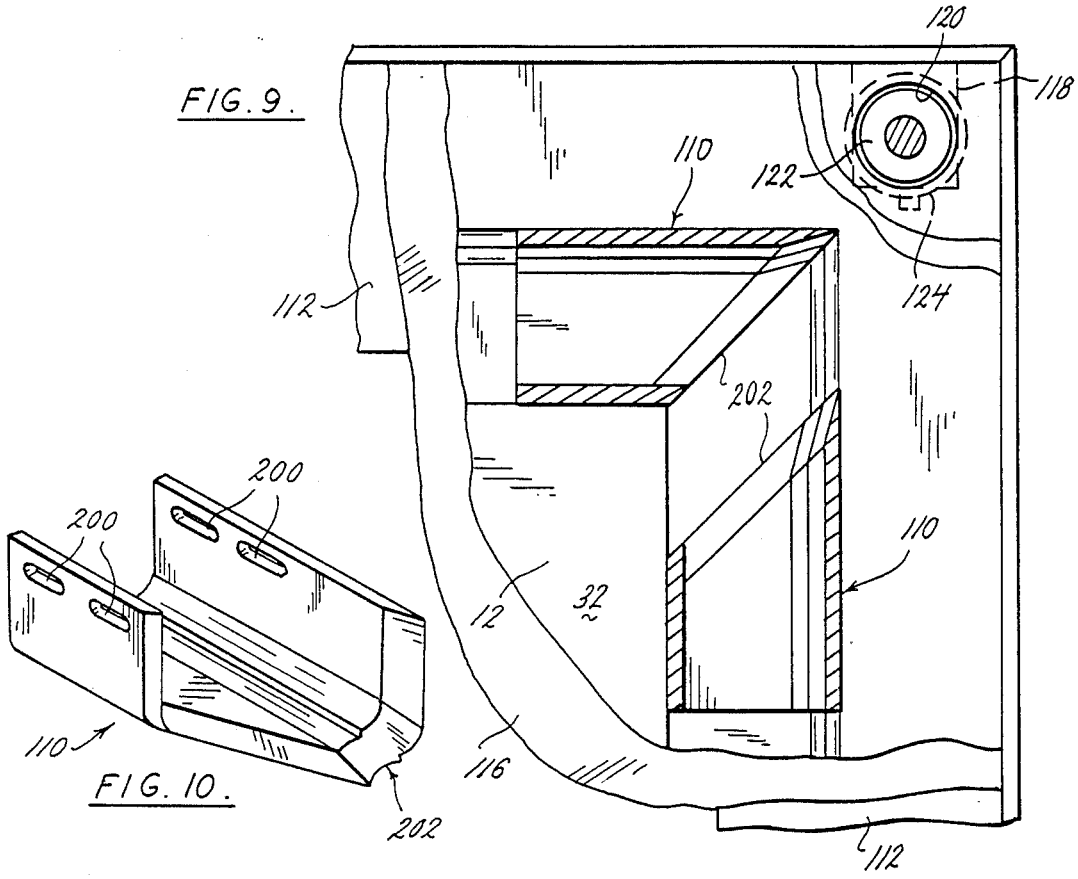
FIG. 9.
FIG. 10.
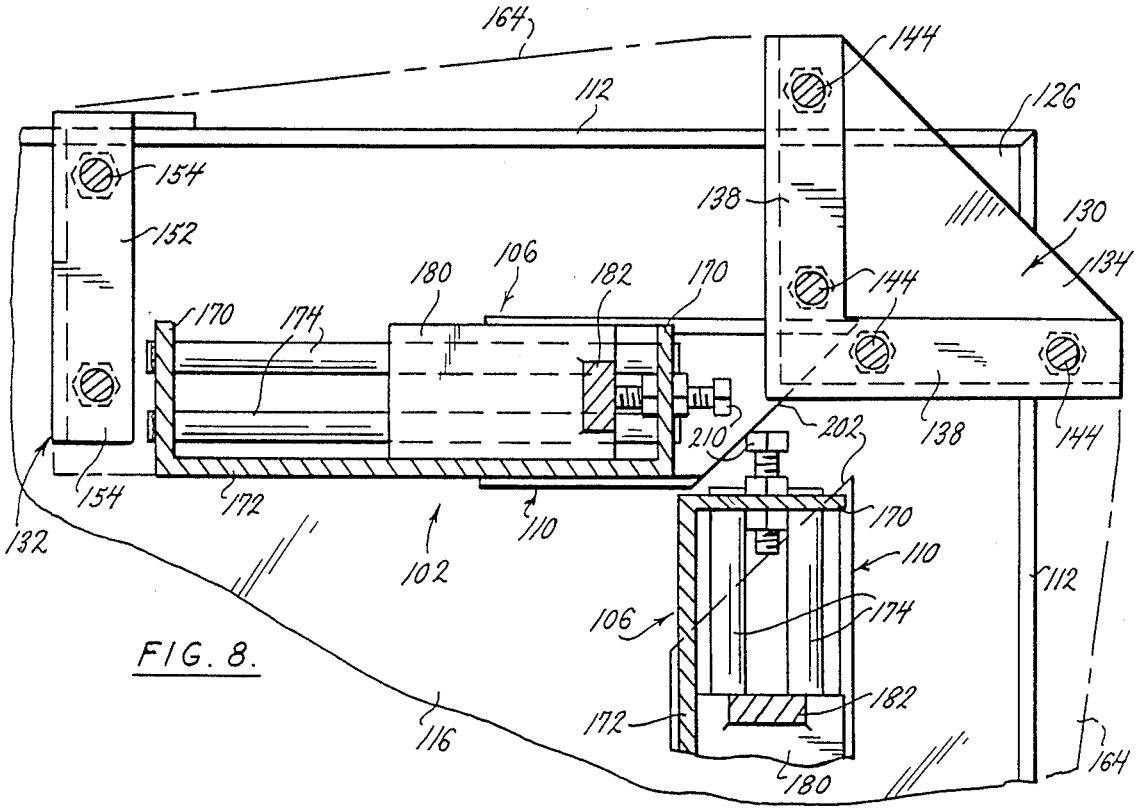
FIG. 8.

CORNER CUTTING SHEAR MACHINE AND METHOD FOR FORMING INSIDE CORNERS IN A ONE-PIECE ARTICLE

BACKGROUND AND SUMMARY OF THE INVENTION

This invention is generally directed to a machine and method for forming inside corners in a one-piece panel or other one-piece article, and more particularly for forming grooves or members defining profiles that merge or meet at corners to define miter lines, such that the corners have inside corner portions. The invention is particularly useful in producing one-piece raised panels.

Raised relief panel construction is widely used such as for cabinet and full-length wall doors. Typically, such construction is with multiple pieces including stiles, rails, and central panels, machined and joined together to form the raised panel door. Such a construction has found great customer appeal and acceptance. Nevertheless, this old type construction is relatively expensive considering the labor costs involved, and has proven to be completely unsatisfactory for certain types of cabinet and door finishes.

For example, certain new high gloss, paint, veneer, and laminate finishes have become popular. They require a core that is dimensionally stable to resist cracking. Because the old stile and rail construction expands and contracts with changes in temperature and humidity, it is not suitable with many of these finishes as cracks will develop in the finish and become unappealing.

One attempt to solve the problem of cracking, at least with respect to a high gloss finish, has been a product having an outer plastic layer molded on a wood core. However, the product is relatively expensive, and because it is produced by molding only certain sizes are available thus limiting the availability of the product for certain customer applications.

The present invention provides a solution. In accordance with the machine and method of the present invention, and with particular reference to raised panels, a one-piece raised panel can be produced easily and inexpensively.

It is formed from a single board or workpiece having length and width dimensions of that of the panel to be formed. Grooves are formed in a face surface of the work piece with the cross-section of the grooves being of a selected shape. Preferably, the grooves are of constant and identical cross-section. The grooves surround a central portion that gives the appearance of a raised panel because of the relief or recess formed by the grooves. A raised border area surrounds the grooves and has the same appearance due to the relief provided by the grooves as the stiles and rails of the conventional raised panel construction. The panel is formed from a material that may be readily machined by shearing and may include any suitable wood-like material, such as natural wood, particle, or fiber board (including what is known in the trade as medium density fiber board), as well as plastics, foam, or other synthetics or composite materials.

The problem is with machining the grooves at the corners such that the grooves meet to define miter lines and such that the cross-sectional shape of each groove remains constant all the way into the corner areas. The central portion of each groove can be machined using a routing technique, spindle shaper, or the like, with a rotary cutter that gives the desired cross-sectional shape to the groove. However, such machining techniques cannot be used to form the inside corner portions at the corners.

In accordance with the method of the present invention the central portion of each groove is formed by machining a face surface of the panel using a spindle shaper or similar wood working machine. Preferably such machine is used to form the majority of the groove except for the extreme corner areas and particularly except for the inside corner portions at the corners. Such a machine may not form so much of the corner area of a groove that it cuts into the adjacent groove at the corner.

The machining of the corners is completed by shearing the material at each corner using a shear cutter with a cutting edge that conforms to the cross-sectional shape of the groove. The cutter fits in the groove portion previously formed by the rotary cutter and moves along the groove to complete the machining of the corner area. The cutting edge of the cutter is mitered so that it aligns with the miter line when the cutter is at a corner. After a first shear cutter is moved along one of the grooves into the corner to complete the machining of the one groove at the corner area, a second cutter having a cutting edge that conforms to the shape of the adjacent groove is moved along the adjacent groove into the corner to complete the machining of that groove, and hence the machining of the corner. The results are a perfectly machined grooves that surrounds the raised central panel and which themselves are surrounded by a raised border and where each groove is of constant cross-section even into the extreme corner areas.

In accordance with the machine of the present invention there is provided a table for supporting a panel having the grooves partially formed by a rotating cutter. The machine further comprises first and second cutter assemblies, each having a shear cutter mounted for movement along a path between retracted and extended positions, the path of movement of the cutter of the first assembly merging at a corner with the path of movement of the cutter of the second assembly. The panel is mounted on the table with the cutters positioned and seated within adjacent grooves. Means are provided for driving each of the cutters along its respective path, within the groove in which it is positioned, between the retracted and extended positions. Driving each cutter to its extended position shears the material near the corner to form the remainder of the groove including the inside corner portion at the extreme corner. Adjustments are provided to accurately position the cutters in the grooves.

While the invention is particularly useful in producing one-piece raised panels, it is readily adaptable for producing other one-piece articles having inside corners that may not be formed using rotary cutters. For example, the invention can be used for producing one-piece frames having inside corners.

Hence it is a primary object of this invention to provide a machine and method for forming inside corners in a one-piece panel or other one-piece article that is of high structural quality, inexpensive to manufacture, and possesses the advantages of dimensional stability and crack resistance afforded by one-piece construction.

DESCRIPTION OF THE DRAWINGS

FIG. 1 is a sectional view illustrating the forming of the central portions of the grooves in a one-piece raised panel in accordance with the invention.

FIG. 2 a partial perspective of a one-piece raised panel in accordance with the present invention showing its stage of completion after machining as shown in FIG. 1.

FIG. 3 a perspective view similar to FIG. 2 but showing the completed one-piece raised panel formed in accordance with the machine and method of the present invention.

FIG. 4 is a plan view of the machine of the present invention for forming the groove portions at the extreme corners where the grooves meet.

FIG. 5 is a left end elevation view of FIG. 4.

FIG. 8 is a view in section taken generally along the line 8—8 of FIG. 6.

FIG. 9 a view in section taken generally along the line 9—9 of FIG. 6.

FIG. 10 a perspective view showing a typical shear cutter used with the machine of the present invention for forming the groove portions and inside corner portions at the extreme corners.

DETAILED DESCRIPTION OF THE PREFERRED EMBODIMENT

Figure 7:
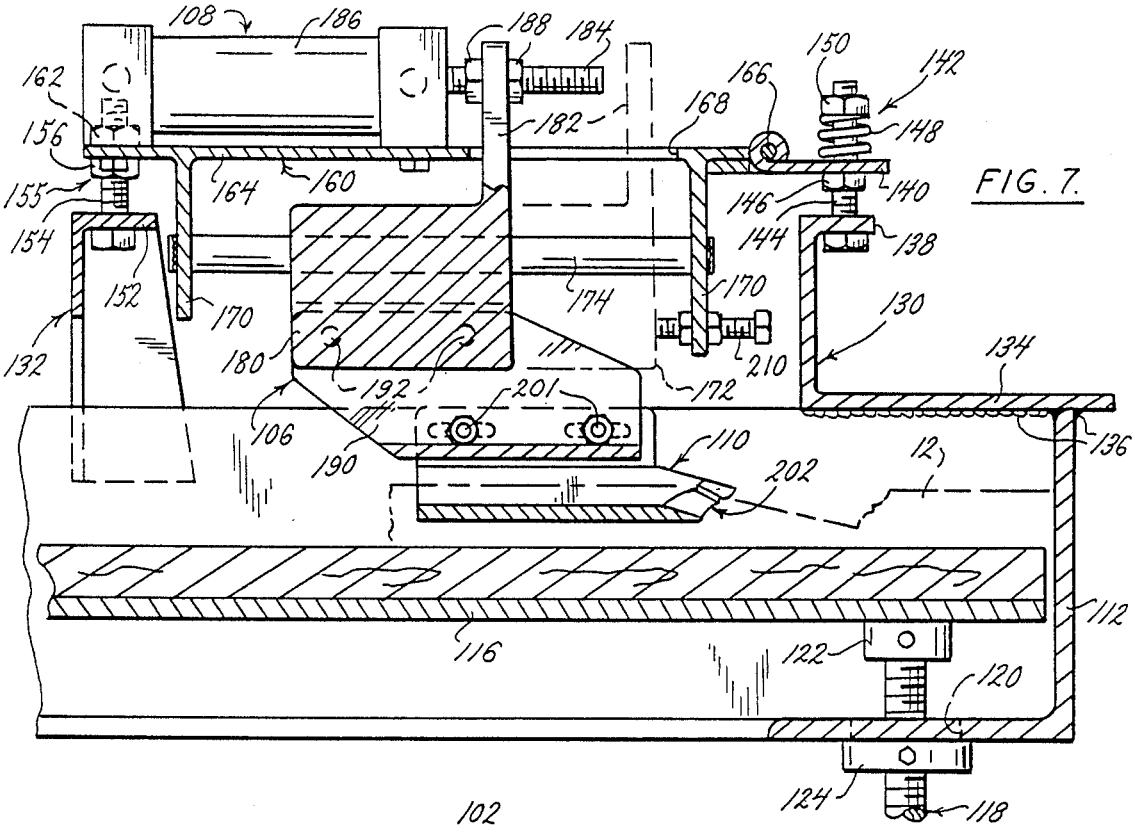
FIG. 7 is a view in section taken generally along the line 7—7 of FIG. 4.

With reference to FIGS. 1–3, there is shown a one-piece raised panel 10 formed in accordance with the present invention. The panel is formed from a board or workpiece 12 having front and rear face surfaces 14 and 16, and side edges 18. While the invention is described for forming a one-piece raised panel, it is to be understood that it also may be used to form other one-piece articles having inside corner portions.

Grooves 20, 22 and 24 are in the face surface 14. FIGS. 2 and 3 are partial views and it is to be understood that the complete panel of this preferred embodiment is rectangular and there is another groove parallel to the groove 22 such that the grooves in combination form a rectangular recess 26. It is further to be understood that while a rectangular panel with a rectangular recess is shown for purposes of this embodiment, the machine and method of this invention may be used to produce raised panels and recesses of other shapes.

With reference to FIG. 3, the grooves 20 and 22 are adjacent and merge at a corner 28. The grooves 22 and 24 are also adjacent and merge at a corner 30.

The recess 26 defines a raised central portion 32 such that the recess surrounds the central portion. The recess also defines a raised rectangular border 34 that surrounds the recess. In other words, the formation of the recess creates the raised central portion and border from the original single-piece board 12.

Preferably, the grooves have the same cross-sectional shape which remains constant throughout the recess. Any of a wide variety of shapes may be chosen. The one illustrated is a common shape often found in the conventional stile and rail raised panel. It includes a short wall 40 surrounding the raised central portion. A gently sloping wall 42 extends outwardly from the wall 40 and more deeply into the board where it terminates at the bottom of an outer groove surface 44. The outer groove surface includes a bottom, generally convex, wall section 46 extending from the bottom of the wall 42 generally upwardly and outwardly to the base of a short wall section 48 that parallels the wall 40. A generally concave upper wall section 50 extends from the top of the wall 48 generally outwardly and upwardly to the face surface 14 at the border 34.

Each section of a groove meets or merges with a like section of an adjacent groove at a corner, with each section maintaining its cross-sectional shape as it extends all the way into the corner thereby creating a miter line 56 at each corner where the adjacent grooves meet. The miter line 56 is straight when viewed normal to the face of the panel. In other words, the miter line 56 appears as if it were a miter joint were the grooves formed of multiple pieces and joined together at the corners. The inside corner portion 60 is generally that portion of the miter line 56 where the outer groove sections 44 of adjacent grooves meet.

The panel is of one-piece construction of a material that is readily machined by shearing and may include any suitable wood-like material such as natural wood, particle board or fiber board, as well as plastics, foam, or other synthetics or composite materials.

FIG. 2 illustrates a partially formed one-piece raised panel. Nearly all of the grooves are formed except for the outer groove sections 44 at the corners such that the inside corner portions 60 shown in FIG. 3 are not present in FIG. 2.

The panel in its stage of completion as shown by FIG. 2 may be formed with a shaper generally illustrated in FIG. 1. The shaper 70 has a table 72 with an adjusted guide or fence 74. The table has an opening 76 through which extends a rotating cutter 78 having a cutting edge 80 of a shape that conforms to the desired cross-sectional shape of the grooves. The grooves are machined by suitably positioning the board 12 on the table and milling the grooves as shown in FIG. 2.

As is apparent, it is not possible to form the complete corners, including the inside corner portions 60, with the shaper illustrated in FIG. 1. The shaper blade may be used to form the central portion of each groove and part of the corner. However, it may not be used to machine so far into the corner that it damages the adjacent groove. For example, if in machining the groove 24 the shaper were used to machine all the way to the corner, it would destroy the adjacent groove 22 in the corner area, and particularly the outside groove section 44 of the adjacent groove. Hence, it will be appreciated that it is not possible to form the entire corner including the outer groove sections in the extreme corner areas so as to achieve constant cross-section and a sharp miter line at the corner using a rotary cutter. The corner portions that cannot be formed using a rotary cutter are formed in accordance with the method and machine of the present invention.

Figure 6:
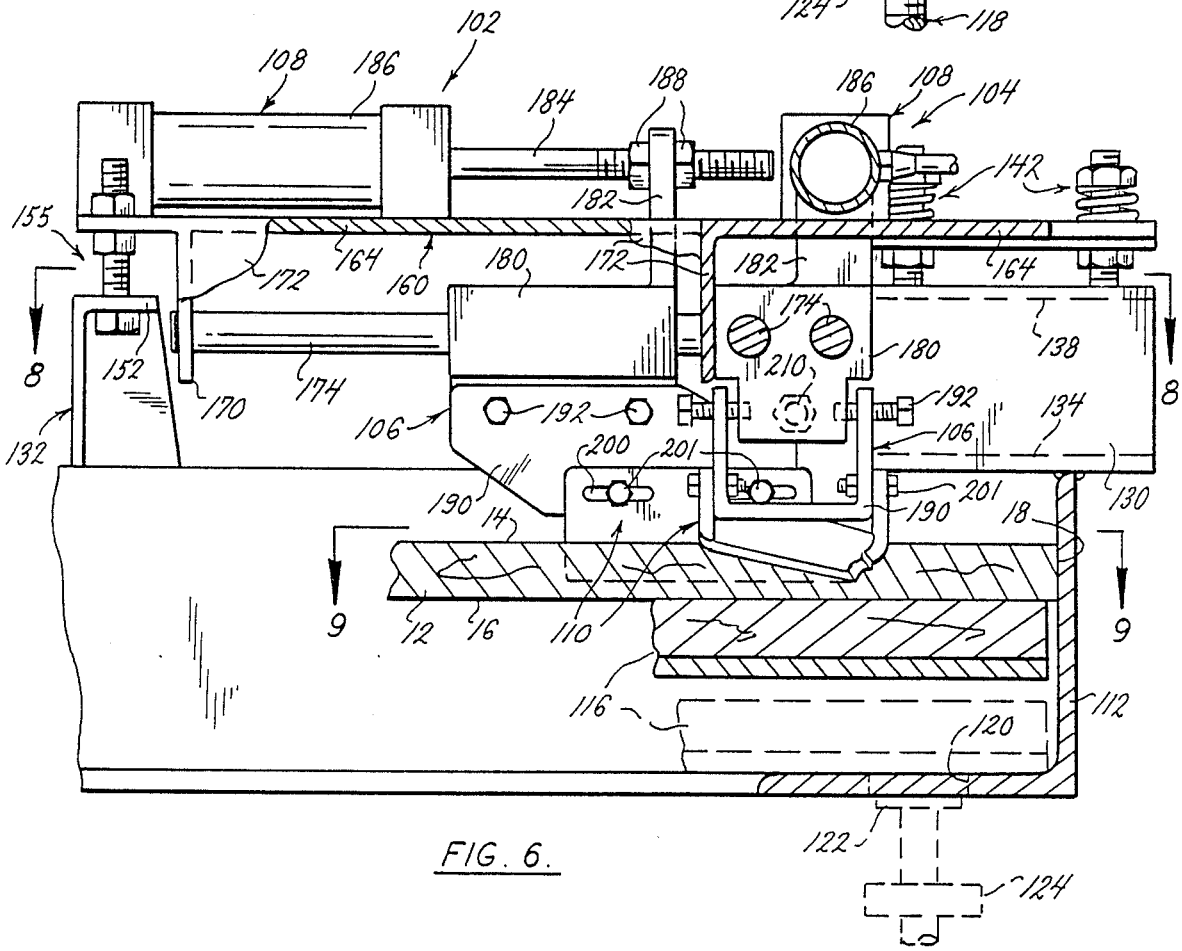
FIG. 6 is a view in section taken generally along the line 6—6 of FIG. 4.

Such a machine is illustrated in FIGS. 4–10. With particular reference to FIGS. 4 and 5, the machine 100 of the present invention generally comprises a table 101 with cutter assemblies 102 and 104 mounted at the top thereof. The cutter assemblies are identical except that they are opposite hand cutter assemblies as they are mounted at 90° as best shown in FIG. 4. Each cutter assembly includes a reciprocal carriage 106, a drive means 108 for reciprocating the carriage, and a shear cutter 110 mounted to the carriage for forming a groove at the corner area.

The table 101 has an upper triangular frame 112 supported on legs 114. A vertically adjustable table top 116 is located within the frame. Actuaters 118 are mounted to each leg near the top. The actuaters may be hydraulic or pneumatic cylinders. Each cylinder piston rod extends upwardly through a hole 120 at each corner of the frame and has a lug 122 at its end. The table 116 is secured to the lugs for vertical movement as shown by the solid and dashed line positions of FIG. 6. Also secured to the piston rod is an adjustable stop 124 that engages the lower side of the frame to limit the amount of upward vertical movement of the table.

The cutter assemblies 102 and 104 are mounted at the 9° corner 126 of the table. Each cutter assembly includes a forward mounting bracket 130 and a rear mounting bracket 132 for mounting the assembly to the frame 112. The forward mounting bracket includes a support plate 134 secured at 136 to the frame. The plate 134 has a horizontal ear 138. A hinge plate 140 is mounted above the ear 138 by adjustable nut and bolt assembly 142. Each such nut and bolt assembly includes a threaded bolt 144 extending through aligned openings in the ear 138 and hinge plate 140. A nut 146 is threaded on the bolt and supports the lower side of the hinge plate, and a spring 148 bears against the upper surface of the hinge plate with force determined by a nut 150. The springs 148 allow some latitude in the contact pressure between the cutters and workpiece to insure proper seating of both cutters within their respective grooves when the table is in the raised position.

The rear bracket 132 is secured to the frame and also has a horizontal ear 152. Threaded bolts 154 of nut and bolt assemblies 155 extend through openings in the ear 152 and have nuts 156 supporting the rear end of a pivotal support bracket 160. Nuts 162 serve to hold the rear end of the bracket 160 in place.

The bracket 160 includes a top plate 164 pivotally mounted at 166 at its forward end to the hinge plate 140, and secured at its rear end by the nuts 156 and 162. The plate 164 has an elongated slot 168 extending fore and aft. Vertical end flanges 170 depend from the plate, and a vertical side flange 172 also depends from the plate and is secured to the ends flanges. Parallel, horizontally spaced, rods 174 extend between the end flanges 170.

Each carriage 106 includes a block 180 having parallel bores through which the rods 174 extend so that the block reciprocates along the rods. The block has a vertical ear 182 that extends through the elongated slot 168 through which a threaded piston rod 184 of an actuater 186 extends. The actuater 186 may be a hydraulic or pneumatic cylinder or any other suitable device for driving the carriage between retracted and extended positions. In this preferred embodiment the cylinder is supported on top of the plate 164, and the threaded piston rod extends through a hole in the ear 182 with nuts 188 to lock the block in a selected fore and aft position on the rod.

The carriage further includes a U-shaped member 190 mounted at the bottom of the block with bolts 192 extending through threaded openings in the U-shaped member and into recesses in the block. By adjusting the bolts 192 the lateral position of the U-shaped member relative to the block, and thus the lateral position of the cutter 110, may be adjusted. Alternately, a single threaded bolt rotatably supported and held in axial position relative to the member 190 may extend through a threaded bore in the block such that rotation of the bolt adjusts the lateral position of the member relative to the block.

The shear cutter 110 is mounted to and depends downwardly from the member 190. The cutter is generally U-shaped as shown in FIG. 10 with horizontal slots 200 in its side walls. FIG. 10 shows one of the cutters, it being understood that the other cutter is an opposite hand cutter. The cutter is secured to the member 190 with nut and bolt assemblies 201 extending through the slots and aligned holes in the member. The slots provide fore and aft adjustment for the cutter to accommodate for decrease in cutter length when the cutting edge is sharpened.

The forward edge of the cutter defines a chisel cutting edge 202. The cross-sectional shape of the cutter conforms identically to the cross-sectional shape of the groove formed by the router cutter 78. The cutting edge 202 is not only beveled to give it a chisel edge, it is also mitered with respect to its path of movement. In this described embodiment the corner is 90° so the angle of the miter is 45°.

A nut and bolt assembly 210 mounted at the bottom of the forward end flange 170 functions as an adjustable stop for the extended or forward position of the carriage 106.

It can be seen that the cutter 110 is easily replaced to accommodate changes in groove shapes to be formed using the machine. The cutter is replaced by removing the nut 162 above the rear of the pivotal bracket 160, and pivoting the entire bracket, including the cylinder, carriage, and cutter about the hinge 166 for easy access to the cutter.

In operation of the machine and use of the method of this invention, first the raised panel of the desired groove shape is brought to the stage of completion as shown in FIG. 2 with the shaper of FIG. 1 or other suitable machine having a rotary cutter to produce the groove portions with the desired cross-section. Preferably, the rotary cutter is used to machine each groove to the further extent possible without damage to the adjacent grooves at the corners.

Next, the workpiece is placed in the machine 100. It is placed in the corner of the table against suitable guides with the grooves facing upwardly and directly beneath and aligned with the paths of movement of the cutters 110. The nut and bolt assemblies 142 at the forward ends of the cutter assemblies, and the nut and bolt assemblies 155 at the rearward ends provide pitch, yaw, and roll adjustment, and the bolts 192 provide lateral adjustment, to properly position and align the cutters so that they will seat within their respective grooves. Also, the stops 124 on the threaded piston rods of the cylinders 118 are adjusted so that with the table top in its upper position as shown by solid lines in FIG. 6, the cutters are fully seated in the grooves. The spring pressure applied by the springs 148 helps insure proper seating of both cutters in their respective grooves to accommodate for slight variations in groove depth and the like. The fore and aft positions of the carriages are adjusted with the nuts 188 on the cylinder piston rods 184, and the forward or extended positions of the carriages are adjusted with the adjustable stops 210, so that with the cutters in their fully extended positions the cutters are exactly located at the corner where the adjacent grooves meet.

After the workpiece is properly positioned on the table beneath the cutter assemblies, and all the necessary adjustments have been made, with the cutters in their retracted positions the table cylinders 118 are actuated to raise the table to its upper position such that the cutters seat within the adjacent grooves. Then, first one of the cylinders 108 is actuated to drive its carriage and cutter forward to its fully extended position with the cutter at the corner. In doing so the cutter travels in the groove portion previously formed by the rotary cutter and shears away the material at the corner to extend the same cross-sectional shape of the groove, including the outer groove section, fully into the corner. After the first cutter is retracted, the cylinder of the second cutter assembly is actuated to drive its carriage and cutter to the fully extended position, and in doing so causes that cutter to shear the material at the corner and extend its groove fully into the corner as with the first cutter assembly. The formation of the grooves at the corner is now complete such that the cross-section is carried fully into the corner to form the inside corner portion and the full miter line at the corner. After the second cutter is retracted, the table is lowered and the workpiece repositioned to machine another corner. Once the machine is set up for a particular panel, the corners are machined very quickly.

The result is an article, such as a raised panel, that has the appearance of conventional multipiece construction, but is one-piece, inexpensive to manufacture, and possesses the advantages of dimensional stability and crack resistance that conventional construction does not have, as well as the advantage of ease and convenience of producing custom sizes.

While the preferred embodiment has been described with respect to a one-piece raised panel, the invention also applies to forming other one-piece articles having inside corner portions. For example, the invention may be used to form one-piece frames, such as for doors, windows, pictures, and the like. As with the central portions of the grooves for a one-piece raised panel, the central portions of the frame members may be formed using rotary cutters. The corner portions are formed by shearing the material at the corner areas as with the raised panel. The shapes of the cutters conform to the cross-sectional shapes of the frame members, and seat with and move along the frame members to the extreme corner in much the same way that the cutters seat with and move along the grooves in forming the raised panel. Hence, the machine and method of this invention may be used to form the inside corner portions of many articles, whether the article be one where the inside corner portions are produced by the meeting of grooves defining profiles as with a raised panel or by the meeting of members defining profiles as with a frame.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A method of forming adjacent first and second grooves in a face surface of a panel material such that the grooves meet at a corner having an inside corner portion, the grooves defining a miter line where they meet at the corner, said method comprising the steps of:

machining portions of said first and second grooves in the face portion of said panel, and shearing the material in the corner to form at least a portion of said inside corner portion.

2. The method of claim 1 wherein said grooves have constant and identical cross-sectional shapes, and wherein said shearing step further comprises shearing said inside corner portion with a shear cutter configured to said cross-sectional shape.

3. A method of claim 2 wherein said shearing step completes the formation of said inside corner portion.

4. A method of forming a one-piece raised panel from a single piece of material, the panel having a plurality of grooves in a face surface thereof defining a central raised portion surrounded by said grooves and an outer raised portion surrounding said grooves, each groove meeting at a corner with another adjacent groove to define a miter line, each groove having an outer groove surface that meets with an outer groove surface of an adjacent groove to define an inside corner portion, said method comprising the steps of:

machining the face surface to form a portion of each groove without damaging adjacent grooves, and shearing the material near each corner to form at least a portion of said outer groove surface of each groove without damaging the adjacent grooves with which it meets to at least partly form each inside corner portion and miter line.

5. The method of claim 5 wherein the machining step forms at least part of said miter lines at each corner.

6. The method of claim 5 wherein the shearing step completes the formation of said miter lines and inside corner portions.

7. The method of claim 6 wherein said shearing step is performed using cutters of the same cross-sectional shapes as the grooves to fit within and conform to the shapes of the grooves, said cutters having mitered cutting edges that align with the miter lines when the cutters are at corners.

8. The method of claim 7 further comprising the steps of:

after said machining step, positioning said cutters in groove portions formed by said machining step such that the cutters are seated within the groove portions with the cutting edges parallel to miter lines at the corners, and moving the cutters relative to said panel along said groove portions toward said corners while holding the cutters in seated positions within said groove portions until the cutters align with said miter lines, the cutters shearing the material near the corners to form the remainder of said grooves including the inside corner portions.

9. The method of claim 8 wherein said corners are right angle corners.

10. The method of claim 4 wherein said material is a wood-like material.

11. A method of forming a one-piece raised panel from a single piece of material, the panel having a plurality of grooves in a face surface thereof defining a central raised portion inwardly of said grooves and an outer raised portion outwardly of said grooves, said grooves having constant and identical cross-sectional shape and each groove meeting at a corner with an adjacent groove to define a miter line, each groove having an outer groove surface that meets with the outer groove surface of an adjacent groove to define an inside corner portion, said method comprising the steps of:

machining the face surface to form a portion of each groove without damaging an adjacent groove with which it meets, after said machining step, positioning a cutter in the groove portion formed by said machining step such that the cutter is seated within the groove portion, the cutter having the same cross-sectional shape as the groove portion in which it is seated to fit within and conform to the shape of said groove portion and having a mitered cutting edge that aligns with a miter line when the cutter is at a corner, the cutter seated within the groove portion with its cutting edge parallel to said miter line, moving the cutter relative to said panel along said groove portion toward a corner while holding the cutter in its seated position within said groove portion until the cutter is aligned with said miter line, the cutter shearing the material near the corner to form the remainder of said groove including the inside corner portion, and repeating said steps to form the grooves including the inside corner portions.

12. The method of claim 11 wherein the machining step is performed on all of the grooves before the shearing step is performed on any groove.

13. A machine for forming adjacent first and second grooves in a face surface of a panel material, such that the grooves meet at a corner to define a miter line, each groove having an outer groove surface that meets with an outer groove surface of the other groove to define an inside corner portion, said machine comprising:

first and second cutter assemblies each having a shear cutter, means for mounting each shear cutter for movement along a path between retracted and extended positions, the path of movement of the cutter of the first assembly meeting with the path of movement of the cutter of the second assembly, means for mounting said panel having partial grooves formed therein with said cutters positioned and seated in said grooves, the grooves aligned along the paths of movement of said cutters, and means for driving each of the cutters along its respective path within the groove in which it is positioned between said retracted and extended positions, whereby driving the cutters to the extended positions shears the material near the corner to form the remainder of the grooves including the inside corner portion.

14. The machine of claim 13 wherein each cutter has a mitered cutting edge that aligns with the miter line when the cutter is at the corner.

15. The machine of claim 13 further comprising a table for supporting said panel, and means for adjusting the relative height of the table and cutters for positioning the cutters in the grooves.

16. The machine of claim 13 further comprising carriages to which said cutters are mounted, said carriages mounted for movement along said paths, and means for driving said carriages along said paths between said retracted and extended positions.

17. The machine of claim 13 further comprising means for adjusting the pitch, yaw, and roll positions of each cutter to accurately position the cutters within the grooves.

18. The machine of claim 17 further comprising adjustable stop means for limiting the extended travel of each cutter.

19. The machine of claim 18 further comprising means for adjusting the fore and aft positions of said cutters relative to said drive means.

20. The machine of claim 18 further comprising means for adjusting the lateral positions of said cutters.

21. The machine of claim 13 wherein the paths of movement of said cutters are at right angles.

22. A machine for forming a groove in a face surface of a panel material, said machine comprising:

a cutter assembly having a shear cutter, means for mounting the shear cutter for movement along a path between retracted and extended positions, means for mounting said panel having a partial groove formed therein with said cutter positioned and seated in said groove portion, said groove portion aligned with the path of movement of said cutter, and means for driving said cutter along its path within said groove portion in which it is positioned between said retracted and extended positions, whereby driving the cutter to its extended position shears the material near the end of the groove.

23. The machine of claim 22 wherein said cutter has a cutting edge of the same cross-sectional shape as the groove portion to fit within and conform to the shape of the groove portion in which it is positioned.

24. The machine of claim 22 wherein said cutter has a mitered cutting edge that aligns with a miter line when the cutter is at an end of the groove.

25. The machine of claim 22 further comprising a table for supporting said panel, and means for adjusting the relative heights of the table and cutter for positioning the cutter in the groove portion.

26. The machine of claim 22 further comprising a carriage to which said cutter is mounted, said carriage mounted for movement along said path, and means for driving said carriage along said path between said retracted and extended positions.

27. The machine of claim 22 further comprising means for adjusting the pitch, yaw, and roll of the cutter.

28. The machine of claim 27 further comprising adjustable stop means for limiting the extended travel of the cutter.

29. The machine of claim 28 further comprising means for adjusting the fore and aft positions of said cutter relative to said drive means.

30. The machine of claim 28 further comprising means for adjusting the lateral position of said cutter.

31. A method of forming an inside corner portion in a one-piece article material, the inside corner portion produced by the meeting at a corner of first and second adjacent profiles, said method comprising the steps of:

machining said article material to form portions of said profiles not including the entirity of said inside corner portion, and shearing said article material in the corner to form said inside corner portion.

32. The method of claim 31 wherein said profiles are defined by grooves.

33. The method of claim 31 wherein said profiles are defined by members.

34. The method of claim 31 wherein said shearing step is performed using cutters of the same cross-sectional shapes as the profiles to fit with and conform to the shapes of the profiles, said cutters having mitered cutting edges that align with a miter line, defined where the profiles meet at the corner, when the cutters are at the corner.

35. The method of claim 34 further comprising the steps of:

after said machining step, positioning said cutters in seating engagement with said profile portions formed by said machining step such that the cutters are seated with the profile portions with the cutting edges parallel to the miter line at the corner, and moving the cutters relative to said article along said profile portions toward said corner while holding the cutters in seated positions with said profile portions until the cutters align with said miter line, the cutters shearing the material near the corner to form the inside corner portion.

36. The method of claim 35 wherein said corner is a right angle corner.

37. A machine for forming an inside corner portion in a one-piece article material, the inside corner portion produced by the meeting at a corner of first and second adjacent profiles, and where said profiles define a miter line where they meet at the corner, said machine comprising:

first and second cutter assemblies each having a shear cutter, means for mounting each shear cutter for movement along a path between retracted and extended positions, the path of movement of the cutter of the first assembly meeting with the path of movement of the cutter of the second assembly, mean s for mounting said article having partial profiles formed therein with said cutters positioned and seated with said profiles, the profiles aligned along the paths of movement of said cutters, and means for driving each of the cutters along its respective path while seated with its respective profile between said retracted and extended positions, whereby driving the cutters to the extended positions shears the material near the corner to form the inside corner portion.

38. The machine of claim 37 wherein each cutter has a mitered cutting edge that aligns with the miter line when the cutter is at the corner.

39. The machine of claim 37 further comprising carriages to which said cutters are mounted, said carriages mounted for movement along said paths, and means for driving said carriages along said paths between said retracted and extended positions.

40. The machine of claim 37 further comprising means for adjusting the positions of the cutters relative to the profiles for positioning the cutters in seating engagement with said profiles.

* * * * *